United States Patent [19]

Choi

[11] 4,105,502

[45] Aug. 8, 1978

[54] SIMPLIFIED LIQUEFACTION PYROLYSIS PROCESS AND APPARATUS THEREFOR

[75] Inventor: Charles K. Choi, Claremont, Calif.

[73] Assignee: Occidental Petroleum Corporation, Los Angeles, Calif.

[21] Appl. No.: 700,009

[22] Filed: Jun. 25, 1976

[51] Int. Cl.[2] ..... C10B 49/16; C10B 55/08; C10G 1/00

[52] U.S. Cl. ..... 201/12; 48/111; 48/209; 48/210; 55/89; 55/228; 201/2.5; 201/22; 201/23; 201/25; 201/28; 202/99; 208/8; 208/11 R

[58] Field of Search ..... 201/2.5, 8, 10, 12, 201/22, 23, 25, 28, 38, 42; 210/512; 208/8, 11 R; 202/84, 85, 99, 108; 48/210, 209, 111, 77, 101

[56] References Cited

U.S. PATENT DOCUMENTS

| | | | |
|---|---|---|---|
| 2,582,712 | 1/1952 | Howard | 201/42 X |
| 2,655,443 | 10/1953 | Moore | 48/206 |
| 2,739,104 | 3/1956 | Galbreath et al. | 201/33 X |
| 3,051,629 | 8/1962 | Gorin et al. | 201/22 X |
| 3,533,506 | 10/1970 | Carr | 210/512 R X |
| 3,541,003 | 11/1970 | Carr et al. | 423/659 X |
| 3,779,893 | 12/1973 | Leas et al. | 201/23 X |
| 3,853,498 | 12/1974 | Bailie | 48/210 X |
| 3,992,266 | 11/1976 | Aktay et al. | 201/23 X |

*Primary Examiner*—Joseph Scovronek
*Attorney, Agent, or Firm*—Christie, Parker & Hale

[57] ABSTRACT

Carbonaceous materials are pyrolyzed by simultaneous feed of the carbonaceous materials and a particulate source of heat to a cyclone reactor-separator wherein the centrifugal forces separate the vaporized product of pyrolysis from the solids. The carbon in the solids is partially combusted for recycle to the cyclone reactor separator and the vaporized products quenched and recovered. The yield of liquid hydrocarbons may be maximized.

19 Claims, 2 Drawing Figures

SIMPLIFIED LIQUEFACTION PYROLYSIS PROCESS AND APPARATUS THEREFOR

BACKGROUND OF THE INVENTION

It has been known to flash pyrolyze solid carbonaceous materials in a tubular pyrolysis reactor operated in conjunction with a plurality of cyclones for separation of the solids from the gases resulting from pyrolysis, the gases being fixed in part and condensible in part. The system is operated in conjunction with a system to decarbonize a portion of the solids resulting from pyrolysis to yield a particulate heat source for feed to the tubular flash pyrolysis reactor.

While extremely functional, the system is most complex involving two tubular reactors, one for pyrolysis and the other for controlled combustion of the solids to provide the particulate source of heat for pyrolysis.

Associated with each tubular reactor are a plurality of cyclones for a solids-gas separation and a system for recovery of condensible vapors from the products of pyrolysis along with compressors to assist in returning the fixed gases as a transport gas back to the system.

Because of the equipment involved, capital investment and operating costs are relatively high and in some instances, it would be economically unjustified to use the apparatus for the production of liquids. A need, therefore, exists for a more simplified flash pyrolysis process, particularly useful for liquefaction which is economical, low in cost and simple to operate.

SUMMARY OF THE INVENTION

According to the invention, there is provided a simplified method for pyrolysis of carbonaceous materials, and apparatus for carrying out the method.

In the pyrolysis process of this invention there is tangentially introduced to the inlet of a cyclone reactor-separator zone having a vapor outlet at one end and a solids outlet at the opposed end, a high velocity stream of carbonaceous material to be pyrolyzed with a particulate solid source of heat at a temperature above the pyrolysis temperature and contained in a carrier gas essentially free of oxygen. This forms a high velocity mixture of carbonaceous material and particulate solid source of heat which causes pyrolysis of the carbonaceous material by transfer of heat from the particulate solid source of heat. To achieve pyrolysis, the weight ratio of inert solids to carbonaceous material is sufficient to achieve a pyrolysis temperature of at least about 600° F. Pyrolysis yields a pyrolytic vapor containing normally condensible and non-condensible hydrocarbons and a carbon containing solid residue. Centrifugal forces simultaneously cause separation of the particulate solid source of heat and carbon containing solid residue of pyrolysis from the carrier gas and pyrolytic vapors.

The pyrolytic vapors and carrier gas are separated from vapor exhaust and cooled to recover the condensible hydrocarbons. Concurrently, a mixture of the particulate solid source of heat and the carbon containing solid residue is separated from the solids exhaust. At least a portion of the mixture of particulate solid source of heat and carbon containing solid residue is transported to a combustion zone. There the contained carbon is combusted to form the particulate solid source of heat and essentially oxygen free flue gas as a carrier gas for feed to the tangential inlet of the cyclone reactor-separator.

The process may be carried out at a temperature from about 600° F to about the softening temperature of the inorganics in the solid heat which may lead to slagging or sintering, preferably from about 600° to about 2000° F. For liquefaction, pyrolysis temperatures will range from about 600° to about 1400° F, preferably from about 900° to about 1400° F. Effective contact times will range from about 0.1 to about 3 seconds, preferably from about 0.1 to about 1 second. To achieve pyrolysis the weight ratio of the particulate solid source of heat to carbonaceous material will range from about 2 to about 20. Generally, temperature of the solid source of heat will be from 100 to about 500° F above the pyrolysis temperature. Introduction velocities will generally range from about 100 to about 250 feet per second.

Although pyrolysis is essentially terminated once solids-gas separation occurs in the cyclone reaction separation zone, to finally terminate pyrolysis, the gaseous effluent is passed to a quench zone where it is brought in contact with a quench fluid, preferably a portion of the hydrocarbon condensate. The quench fluid reduces gas temperature below the dew point of the condensible hydrocarbons and the mixture is fed to a recovery zone, such as, for instance, a fractional distillation column. The off-gases pass overhead and the middle cut hydrocarbon product withrawn from the center of the fractionation zone. The heavy hydrocarbons are withdrawn from the base. A portion is returned to the fractionator, another portion employed as a quench, another portion may be returned to the pyrolysis zone for pyrolysis to extinction, and the balance may be withdrawn as heavy product oil.

The preferred recovery route from the condensible hydrocarbons from the pyrolysis of solid wastes is to first quench cool the mixture of carrier gas, flue gas and pyrolytic vapors by contact with an immiscible quench oil, then passing the mixture to a cyclone decanter zone which serves to separate the residual gas stream from the condensed hydrocarbons and fractionate the condensed hydrocarbons into a quench oil fraction and heavy hydrocarbon fraction. The quench oil fraction is cooled for recycle as the quench. The heavy hydrocarbon fraction is then separated into a product oil and a crude slurry for recycle to the pyrolysis zone.

The particulate source of heat is provided by combustion of the carbon contained in the solids recovered from the cyclone reactor-separator. Preferably, this is accomplished by transporting the mixture of spent particulate solid heat source and carbon containing residue through a transport conduit as a dense phase using an oxygen containing transport gas, typically air. This initiates oxidation. From there the mixture is expanded in a dilute phase combustion zone where additional oxygen containing gas, typically air, is added to generate by partial oxidation sufficient heat to maintain the particles at a temperature consonent with the requirements of pyrolysis. The flue gas stream is constantly monitored to assure the essential absence of oxygen to permit its use as the carrier gas.

The apparatus employed to carry out the pyrolysis process of this invention consists of a cylcone reactor-separator for pyrolysis of carbonaceous materials in admixture with a heated particulate source of heat while serving to simultaneously separate the gases from the solids introduced.

A conduit couples the gas effluent of the cyclone reactor to a quench zone including means to introduce a quench fluid to cool the gaseous products of pyrolysis.

The quench zone is coupled to an open relation with a cyclone decanter which includes means to separate the liquids from the gas phase and means to separate the quench fluid from a heavy hydrocarbon oil. Associated with the decanter is a system to recovery product oil from the heavy hydrocarbon oil.

Coupled to cyclone reactor is a vertical standpipe which collects solids from the cyclone reactor-separator which includes means to meter the solids for collection as product and for introduction to an angle riser. The angle riser is connected to a dilute phase combustion zone for combustion of the portion of the carbon contained in the solids to yield a particulate source of heat for feed to the cyclone reactor-separator and a flue gas as transport gas.

THE DRAWINGS

DESCRIPTION

In accordance with the present invention, there is provided a process for the pyrolysis of carbonaceous materials which is selected for liquefaction and for gasification operations and the apparatus used therefore.

The carbonaceous materials which may be pyrolyzed in accordance with the present invention include solids such as agglomerative coals, non-agglomerative coals, tar sands, oil shale, the organic portion of solid wastes and the like as well as liquid hydrocarbons such as shale oils, tar sand oils, hydrocarbons resulting from refinery and pyrolysis and like operations. The hydrocarbon should be flowable into the reactor alone or with the aid of a carrier gas. For solids the ideal particle size is less than about 1000 microns, and in the instance of agglomerative coals less than about 250 microns.

Pyrolysis of such material is carried out at a temperature from about 600° F to the temperature at which the inorganic portion of the particulate solid source of heat or carbonaceous feed begins to soften leading to slagging or fusion, preferably from about 600° to about 2000° F. When liquefaction is the primary object pyrolysis occurs at temperatures from about 600° to about 1400° F, preferably from about 900° to about 1400° F. Pyrolysis under gasification conditions, i.e., above about 1400° F can also be carried out.

Although some tars are formed and normally non-condensible hydrocarbons, the liquid products to be obtained are hydrocarbons ranging from $C_5$ hydrocarbons to those having an end point of about 950° F. These hydrocarbons are most used for refining or processing to fuels such as gasoline, diesel fuel and the like. In the instance of pyrolysis of solid waste, the hydrocarbons are highly oxygenated as herein explained. To maximize their formation by minimization of continued cracking following primary pyrolysis requires short effective pyrolysis contact times. Pyrolysis contact times may range up to about 3 seconds, typically from about 0.1 to about 1 second and preferable from 0.1 to about 0.6 second.

As used herein, the term "pyrolysis contact time" or "contact time" refers to the time from when the carbonaceous material first contacts the particulate source of heat until the vaporized hydrocarbon products separate from the particulate solid source of heat. A convenient measure is the average residence time of the transport or carrier gas in the cyclone reactor separator. The lower limit is the time required for the carbonaceous material to be heated to the pyrolysis temperature.

In practice, contact times will vary depending on particle size. For example, other factors being constant, contact time required to raise particles of about 250 microns to about 1000° F will be about 1.5 seconds and 0.5 second for particles of about 75 microns in diameter.

Figure 1:
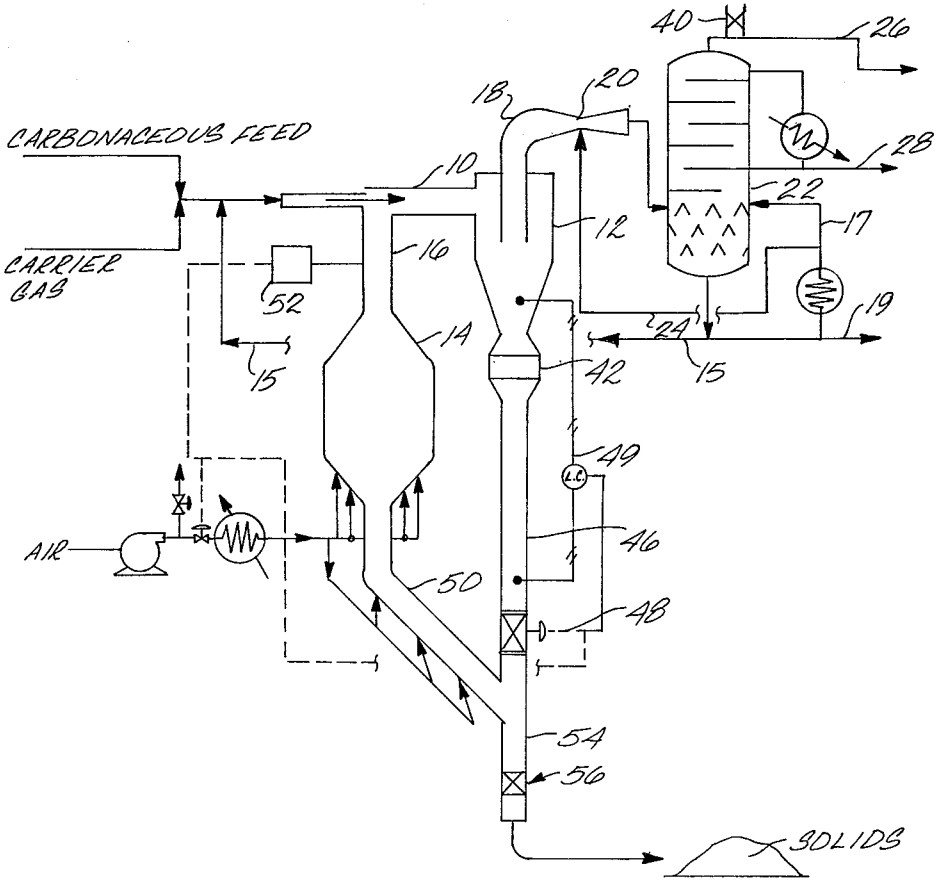
FIG. 1 illustrates the simplified flash pyrolysis system of this invention with a recovery system of broad application where the quench oil used is a portion of the pyrolysis product oil which is miscible with other portions of the pyrolysis product oils.
Figure 2:
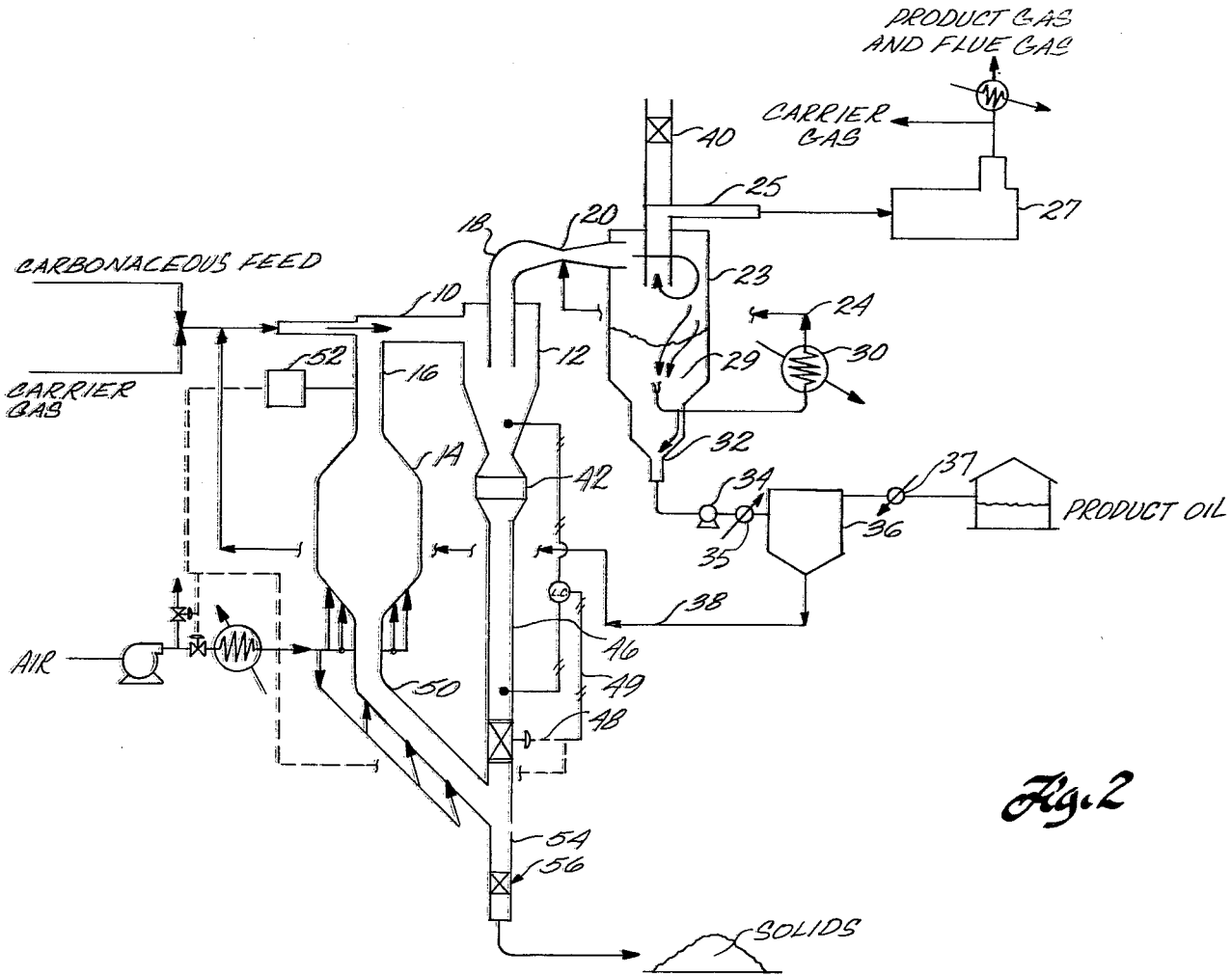
FIG. 2 illustrates the use of simplified flash pyrolysis sytem in combination with a recovery system adapted to recovery of hydrocarbons generated in the pyrolysis of the organic fraction of solid wastes wherein the quench oil used is externally supplied and immiscible with the pyrolysis product oil.

With reference now to FIGS. 1 and 2, the carbonaceous feed alone or with a suitable carrier gas is introduced to tangential inlet 10 of cyclone reactor-separator 12. There is simultaneously formed in dilute phase burner 14 a particulate source of heat of a particle size set forth above with an essentially oxygen free flue gas.

By the term "essentially oxygen free flue gas" there is meant a gas stream void of oxygen to one where oxygen content is less than that required to initiate spontaneous combustion of carbon. The effluent of burner 14 enters conduit 16 for combination with the carbonaceous feed gas in the tangential inlet line 10.

The carrier gas for the carbonaceous feed, if used, is a gas which is non-deleteriously reactive with respect to the products of pyrolysis. By the term "non-deleteriously reactive" as applied to a carrier gas there is meant a gas essentially free of free oxygen, but which may contain constituents which react with and upgrade the value of the pyrolysis products. To be avoided are constituents which degrade the pyrolysis products. It may be, for instance, a portion of the flue gas from burner 14, off gases from the process or a separate gas such as nitrogen, and hydrogen if it is desired to saturate the olefinic materials formed by pyrolysis.

The carbonaceous feed and the particulate solid source of heat, which is normally a mixture of char and ash, enter cyclone reactor at a high velocity, typically a velocity about 100 to about 250 feet per second.

As a consequence, the carbonaceous feed as well as the particulate source of heat rapidly mix both in tangential nozzle 10 of cyclone reactor-separator 12 and in the cyclone. Essentially, instantaneous heat transfer occurs even in nozzle 10. Accordingly, the pyrolysis reaction occurs both in injection nozzle 10 and cyclone reactor 12. Devolatilization of hydrocarbon molecules from the carbonaceous feed occurs with attendant cracking reactions. Cyclone reactor is maintained at the desired temperature for pyrolysis and, for this, is dependent upon the quantity and temperature of the particulate heat source utilized for pyrolysis. The amount of liquid oil products will vary with temperature and contact time with the greatest amount produced at lower pyrolysis temperatures and the lower effective pyrolysis contact times.

To achieve pyrolysis, the temperature of the particulate solid source of heat will generally be from about 100° to about 500° F above the temperature of carbonaceous material. For pyrolysis, the weight ratio of particulate heat source to carbonaceous feed will range from about 2 to about 20. Typically, solids content in the reactor will be about 0.1 to about 10% by volume.

In cyclone reactor-separator 12, centrifugal forces separate solid particulate source of heat and carbon containing solid residue of pyrolysis, e.g., char from the flue and/or carrier gases as well as the vaporized products of pyrolysis. The separated gases flow in vortex flow to exhaust 18 with the solids spiral along the walls of reactor 12 to receptacle 42. Solids-gas separation effectively terminates pyrolysis and minimizes cracking of vaporized hydrocarbons in cyclone reactor-separator 12.

The gases leaving conduit 18 are a mixture of the carrier and/or flue gases which enter pyrolysis reaction-separation zone 12 and the vaporized products of pyrolysis. The vaporized products of pyrolysis include the normally noncondensible hydrocarbons containing up to about 4 carbon atoms which may be saturated or unsaturated as well as condensible hydrocarbons, normally hydrocarbons having greater than about five carbon atoms in the molecule. The hydrocarbons may be saturated or unsaturated. The amount of saturated hydrocarbons present will diminish if free hydrogen is present as part of the feed formed in situ by a water-gas shift reaction by introducing steam into the cyclone reaction-separation zone.

The carrier gas along with the pyrolytic vapor exit reactor 16 enter venturi mixer 20 where they are contacted with a quench fluid to reduce gas temperature at least below pyrolysis and cracking temperatures to prevent further cracking reactions from occurring. Preferably, the quench fluid reduces temperatures below the dew point of the condensible hydrocarbons. A portion of the condensed heavier hydrocarbons formed from the pyrolysis reactor may be employed as quench fluid and fed to venturi by line 24. Immiscible quench oils may also be used and, when used, are separated from the products and recycled to venturi 20.

With reference to FIG. 1, for pyrolysis of carbonaceous materials such as coal, quench effluent, normally a mixture of gas and liquids, may be fed to fractionating tower 22 equipped with release valve 40 as herein explained. In fractionating tower 22 the carrier gas, flue gas and lighter hydrocarbons are separated from middle distillate hydrocarbons which are, in turn, separated from heavy hydrocarbons. Normally, the gaseous cut, containing about $C_4$ and lower hydrocarbons and flue gas, exit the top of fractionator 22 by line 26. The cut of about $C_5$ to hydrocarbons having an end point of about 950° F which constitutes gasoline, diesel and heating fuel components are separated as middle distillate hydrocarbon products in line 28. A portion may be cooled and recycled as reflux.

The heavy hydrocarbon residue exits the base of fractionator 22 and is cooled. One portion is returned to the fractionator as in line 17, another as quench oil in line 24, yet another as recycle feed in line 15 and the balance recovered as heavy oil product from line 19.

Unlike the hydrocarbon results from the pyrolysis of coals, pyrolysis of the organic fraction of solid wastes yield a condensible fluid which is highly oxygenated, and low in bound sulfur. It is as much as 85%, more typically up to 40% soluble in water acids and bases. Having a typical empirical formula of about $C_5H_8O_2$, it is relatively immiscible in a variety of non-polar organic solvents, such as diesel oil, pentane, decane, dodecane, benzene, hexane, toluene and the like which serve as light hydrocarbon quench oil. Specific gravity is in excess of 1.0 usually from about 1.1 to about 1.4. Where the condensate is from this or similar carbonaceous material, it is preferred to employ the recovery system depicted in FIG. 2.

With reference thereto, the discharge stream from venturi scrubber 20 enters cyclone decanter 23 also at a high velocity and tangential to the conical wall thereof. Velocities may be less than, equal to or greater than the entrance velocity to cyclone reactor-separator 12 depending on line sizing.

In cyclone decanter 23, the centrifugal forces present effect a three way separation. The fixed gases pass out through overhead line 25 for recovery or combustion in off gas burner 27, the effluent of which may be discharged to the atmosphere or used to dry the carbonaceous feed and, if necessary, act as the carrier gas for the carbonaceous feed.

The light hydrocarbon quench oil, normally supplied from outside the process and immiscible with product oil, is withdrawn from the center nozzle 29 of cyclone decanter 23, cooled in heat exchanger 30 and recycled by line 24 to venturi quench scrubber 20.

Due to the centrifugal forces present, and immiscibility between the product oil and quench oil, the heavier hydrocarbon oils travel along the inner walls of the cycline decanter 23 and avoid recovery nozzle 29 and gravitate to the base of cyclone decanter 23. The heavier oils are pumped by pump 34 through heater 35 to centrifugal separator 36 which achieves a separation of the heated heavy oil product into a tar like slurry containing the fines which elude recovery in cyclone reactor-separator 12. Vaporized light hydrocarbon constituents are withdrawn at the top, and pass to product recovery. The light hydrocarbons constitute the $C_5$ hydrocarbons to those having an end point of about 950° F. The slurry stream is recyled by line 38 back to inlet 10 for further pyrolysis.

At the top of cyclone decanter 23, there is normally installed a large safety release valve 40 which is provided to account for sudden high pressure buildups in the reactor system due to the possibility of air entering the burner 14 and causing initiation of combustion in pyrolysis reactor 12.

The solid particulate source of heat and the carbon containing solid residue of pyrolysis which settle into receptacle 42 pass to standpipe 46. The solids level in standpipe 46 is controlled by slide valve 48 and controlled by level control system 49. From slide valve 48, a portion of the solids, i.e. a mixture of solid particulate, carbon containing residue of pyrolysis and spent solid source of heat are drawn by the introduction of hot air into angle riser 50 where combustion is initiated. The amount of air provided, however, is a sub-stoichiometric amount.

The solids density in angle riser 50 is normally maintained at a low level, generally from about 10 to about 15 pounds per cubic foot. This density region is termed, for convenience, a lean phase. The partially combusted carbon containing solid residue of pyrolysis and the resultant ash is introduced into expanded dilute phase combustion zone 14 having a cross-sectional area substantially greater than the cross-sectional area of the feed riser. Air is provided around the periphery of the conical base which dilutes solids density in the burner to a relatively low level of from about 5 to about 8 pounds per cubic foot. Combustion in dilute phase burner 14 is carried out to achieve the temperature required for the solids to be introduced to cyclone reactor-separator 12. The amount of air introduced is controlled and monitored by oxygen monitor 52, such that combustion is completed at the exit 16 thereof with complete or essentially complete consumption of oxygen.

Oxygen detector 52 also operates to determine an upset condition. Where, for instance, a large amount of oxygen, e.g. 0.5 to 1 percent by volume is detected, the combustion of air will be instantaneously terminated and slide valve 48 closed. This prevents further introduction of oxygen and the reverse flow of solid particles. The oxygen detector 52 in combination with safety release valve 40 avoid the creation of explosive conditions should an upset occur.

That portion of the solids which are not recycled are withdrawn as product from the base 54 of leg 46 through valve 56.

The novel features of the process and apparatus of this invention and the advantages attendant thereto are several.

The principal advantage is that the cyclone reactor-separator in which pyrolysis occurs under endothermic conditions and the burner 14 where heat is generated by an exothermic oxidation are combined in an integrated system. Carbon combustion is carried out in the dilute phase at a fast rate. Because of the integrated system, size of the overall operation is small compared to existing apparatus. A size reduction of about 80% may be realized and height requirements reduced by 50%. Instead of a multi-loop solids circulator operation, there is, in substance, only employed a single loop solids circulation system.

Since the aeration-transport gas is dilute oxygen, there is no need for separate gas purification facilities or the need to compress recycle off gases as an aeration medium.

In addition, steam may be introduced as part of the aeration medium to react with the carbon contained in the char to generate by water-gas shift reaction, hydrogen for stabilization through hydrogenation of the pyrolysis products.

With respect to product separation, separation of gas and two different liquids, namely the quench oil and heavy product oils may be achieved in a simple cyclone decanter. This enables gas liquid separation to be rapidly carried out in a vessel of relatively small volume. This vessel also enables, because of this centrifugal force present in the location of the light oil tap, separation in one vessel between the light quench oil and the heavy oil product.

What is claimed is:

1. A process for the pyrolysis of carbonaceous materials which comprises:

(a) introducing, at a high velocity, to the tangential inlet of a cyclone reaction-separation zone having a vapor outlet at one end and a solids outlet at the opposed end, a stream of carbonaceous material to be pyrolyzed with a particulate solid source of heat, at a temperature above the pyrolysis temperature, contained in a carrier gas essentially free of oxygen to form a high velocity mixture of the carbonaceous material and particulate solid source of heat and pyrolyzing the carbonaceous material in the mixture by heat transfer from the particulate solid source of heat to carbonaceous material, the best transfer being sufficent to achieve a pyrolysis temperature of at least about 600° F to yield a pyrolytic vapor containing normally condensible and noncondensible hydrocarbons and a carbon containing solid residue while simultaneously centrifugally separating within the cyclone reaction-separation zone, the particulate solid source of heat and carbon containing solid residue of pyrolysis from the carrier gas and pyrolytic vapor;

(b) removing the centrifugally separated carrier gas and pyrolytic vapor from the vapor outlet of the cyclone reaction-separation zone and cooling the separated carrier gas and pyrolytic vapors to condense hydrocarbons therefrom;

(c) removing a mixture of the particulate solid source of heat and the carbon containing solid residue of pyrolysis from the solids outlet;

(d) passing at least a portion of the mixture of particulate solid source of heat and carbon containing solid residue of pyrolysis to a combustion zone to combust carbon therein in the presence of source of oxygen to form the particulate solid source of heat at a temperature required for feed to the cyclone reaction-separation zone, and the carrier gas essentially free of oxygen for feed to the cyclone reactor-separator.

2. A process as claimed in claim 1 in which the pyrolysis temperature is from about 600° to about 2000° F.

3. A process as claimed in claim 1 in which the pyrolysis temperature is from about 600° to about 1400° F.

4. A process as claimed in claim 1 in which the pyrolysis temperature is from about 900° to about 1400° F.

5. A process as claimed in claim 1 in which the introduction velocity to the cyclone reactor-separator is from about 100 to about 250 feet per second.

6. A process as claimed in claim 1 in which the weigh ratio of the solid particulate source of heat to the carbonaceous material is from about 2 to about 20.

7. A process as claimed in claim 1 in which pyrolysis is achieved in a contact time from about 0.1 to 3 seconds.

8. A process as claimed in claim 1 in which pyrolysis is achieved in a contact time of from about 0.1 to about 1 second.

9. A process as claimed in claim 1 in which the carbonaceous material is organic solid waste and in which the condensible hydrocarbons are recovered by:

(a) quenching cooling, in a venturi quench zone, the mixture of carrier and pyrolytic vapors by contact with a cooled light hydrocarbon quench oil in an amount sufficient to condense the condensible hydrocarbons and yield a residual gas stream said cooled light hydrocarbon quench oil being substantially immiscible;

(b) passing the mixture from the quench zone to a cyclone decanter separation zone to separate the residual gas stream from the light hydrocarbon quench oil and condensed hydrocarbons and to separate the condensed hydrocarbons into a light hydrocarbon quench oil and a heavy hydrocarbon fraction; and (c) removing light hydrocarbon quench oil from the cyclone decanter separator zone and cooling the light hydrocarbon quench oil for feed to the venturi quench zone.

10. A process as claimed in claim 9 in which the separated heavy hydrocarbon fraction is heated and passed to a cyclone separation zone for separation into a vaporized light hydrocarbon fraction recovered as product and a heavy residue for recycle to the cyclone reactor-separator as a portion of the carbonaceous feed.

11. A process for the pyrolysis of organic solid waste which comprises:

(a) introducing to a tangential inlet of a cyclone reaction-separation zone having a vapor outlet at one end and a solids outlet at the opposed end, at a velocity from about 100 to about 250 feet per second, a stream of organic solid waste material to be pyrolyzed with a particulate solid source of heat at a temperature above the pyrolytic temperature contained in an essentially oxygen free flue gas to pyrolyze the organic solid waste in the mixture by heat transfer from the particulate solid source of heat to the carbonaceous material, the mixture reaching a pyrolysis temperature of from about 600° to about 2000° F in a pyrolysis contact time of from about 0.1 to about 3 seconds to yield a pyrolytic vapor containing normally condensible and noncondensible hydrocarbons and a carbon containing solid residue while simultaneously centrifugally separating, within the cyclone reaction-separation zone, the particulate solid source of heat and carbon containing solid residue of pyrolysis from the flue gas and pyrolytic vapor;

(b) passing the centrifugally separated flue gas and pyrolytic vapors from the vapor outlet of the cyclone reaction-separation zone to a venturi quench and introducing to the venturi quench zone a cooled hydrocarbon quench oil to condense hydrocarbons to form a mixture of a hydrocarbon condensate, hydrocarbon quench oil and a residual gas comprising the flue gas and noncondensible hydrocarbons said hydrocarbon quench oil being substantially immiscible in the hydrocarbon condensate;

(c) passing the mixture of the hydrocarbon condensate, hydrocarbon quench oil and residual gas to a cyclone decanter zone to separate the residual gas from the hydrocarbon condensate and hydrocarbon quench oil and separate the hydrocarbon condensate as heavy hydrocarbon fraction from the hydrocarbon quench oil;

(d) cooling and passing the hydrocarbon quench oil from the cyclone decanter zone to the venturi quench zone;

(e) separating the heavy hydrocarbon fraction from the cyclone decanter zone;

(f) removing a mixture of the particulate solid source of heat and the carbon containing solid residue or pyrolysis from the solids outlet of the cyclone reactor separator; and (g) passing at least a portion of the mixture of particulate solid source of heat and carbon containing solid residue of pyrolysis to a combustion zone to combust carbon contained therein in the presence of a source of oxygen to form the particulate solid source of heat and essentially oxygen free flue gas for feed to the cyclone reaction-separation zone.

12. A process as claimed in claim 11 in which the separated heavy hydrocarbon fraction is heated and passed to a centrifugal separation zone and further separated into a vaporized light hydrocarbon fraction as produced, a heavy residue and cycling the heavy residue to the cyclone reaction-separation zone.

13. A process as claimed in claim 11 in which the pyrolysis temperature is from about 600° to about 1400° F.

14. A process as claimed in claim 11 in which the pyrolysis temperature is from about 900° to about 1400° F.

15. A process as claimed in claim 11 in which the pyrolysis contact time is from about 0.1 to about 1 second.

16. A process as claimed in claim 11 in which the weight ratio of the particulate solid source of heat to the organic solid waste feed material is from about 2 to about 20.

17. Apparatus for pyrolysis of carbonaceous materials in the presence of a particulate solid source of heat comprising in combination:

(a) a high temperature cyclone separator-reactor having a tangential feed inlet for the carbonaceous material and particulate solid source of heat, a vapor exhaust outlet at one end thereof for removal of vaporized products of pyrolysis and a solids outlet at the opposed end thereof for removal of the particulate solid source of heat and solid products of pyrolysis;

(b) a vertical standpipe coupled in receiving relationship to the solids outlet of the cyclone reactor separator;

(c) a riser connected in solids receiving relationship to the standpipe and to a combustion chamber having a cross-sectional area substantially greater than the cross-sectional area of the vertical riser;

(d) a conduit connected in flow relationship to the combustion chamber and tangential feed inlet of the cyclone reactor-separator;

(e) means to control flow of solids from the standpipe into the riser;

(f) means to introduce a flow of an oxygen containing gas to the riser as a transport combustion gas and the combustion chamber as a combination gas; and (g) quench means coupled in open receiving relation to the vapor exhaust outlet for condensing a portion of the high temperature vapors removed from said cyclone separator-reactor, said quench means including means for introduction of a quench fluid to condense the vapors.

18. Apparatus for pyrolysis of carbonaceous materials such as contained in the organics of solid waste in the presence of a particulate solid source of heat comprising in combination;

(a) a high temperature cyclone separator-reactor having a tangential feed inlet for the carbonaceous material and particulate solid source of heat, a vapor exhaust outlet at one end thereof for removal of high temperature vaporized products of pyrolysis and a solids oulet at the opposed end thereof for removal of the particulate solid source of heat and solid products of pyrolysis;

(b) quench means coupled in open receiving relation to the vapor exhaust outlet for condensing a portion of high temperature vaporized product removed from said cyclone separator-reactor, said quench means including means for introduction of a quench fluid which is substantially immiscible with a liquid pyrolysis condensate formed of pyrolytic vapors by condensation of a portion of the high temperature vaporized product;

(c) a cyclone decanter coupled in open receiving relation to the quench means, said cyclone decanter having an upper exhaust conduit for gas separated from liquids, a centrally positioned nozzle for removal of the light substantially immiscible quench fluid separated during action of centrifugal force from the liquid pyrolysis condensate formed from the pyrolytic vapors, and an exit at the base thereof for the liquid condensate formed from the pyrolytic vapors;

(d) a vertical standpipe coupled in receiving relationship to the solids outlet of the cyclone reactor separator;

(e) a riser connected in solids receiving relationship to the standpipe and to a combustion chamber having a cross-sectional area substantially greater than the cross-sectional area of the vertical riser;

(f) a conduit connected in flow relationship to the combustion chamber and tangential feed inlet of the cyclone reactor-separator;

(g) means to control flow of solids from the standpipe into the riser; and (h) means to introduce a flow of an oxygen containing gas to the riser as a transport combustion gas and the combustion chamber as a combination gas.

19. Apparatus as claimed in claim 18 in which the quench means is a venturi mixer.

* * * * *